US007659803B2

(12) United States Patent
Tay et al.

(10) Patent No.: US 7,659,803 B2
(45) Date of Patent: Feb. 9, 2010

(54) TRANSFORMER WITH FIXED PINS

(75) Inventors: Che-Yong Tay, Taoyuan Hsien (TW); Ching-Sung Kung, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/905,576

(22) Filed: Oct. 2, 2007

(65) Prior Publication Data

US 2008/0084264 A1 Apr. 10, 2008

(30) Foreign Application Priority Data

Oct. 4, 2006 (TW) ..... 95217719 U

(51) Int. Cl.
*H01F 27/29* (2006.01)

(52) U.S. Cl. ..... 336/192

(58) Field of Classification Search ..... 336/65, 336/192, 198, 200, 206–208, 232
See application file for complete search history.

(56) References Cited

U.S. PATENT DOCUMENTS 4,352,081 A * 9/1982 Kijima ..... 336/198

* cited by examiner

*Primary Examiner*—Tuyen Nguyen
(74) *Attorney, Agent, or Firm*—Birch, Stewart, Kolasch & Birch, LLP

(57) ABSTRACT

A transformer with fixed pins is disclosed. The transformer includes a bobbin, a primary winding, a secondary winding, a core set and a plurality pins. The primary and secondary windings are wound around the bobbin and both have a plurality of winding ends. The core set surrounds the primary and secondary windings. Each of the pins is fixed upon the bobbin and electrically connected with a corresponding winding end. The transformer further includes a fixing plate, and the pins are fixed upon the bobbin through the fixing plate.

16 Claims, 7 Drawing Sheets

TRANSFORMER WITH FIXED PINS

CROSS REFERENCE TO RELATED APPLICATIONS

This Non-provisional application claims priority under 35 U.S.C. §119(a) on Patent Application No(s). 095217719 filed in Taiwan, Republic of China on Oct. 4, 2006, the entire contents of which are hereby incorporated by reference.

BACKGROUND OF THE INVENTION

1. Field of Invention

The invention relates to a transformer and in particular, to a transformer with fixed pins.

2. Related Art

The transformer is a commonly used voltage converting apparatus for various electronic devices. The transformer and the circuit board of the electronic device are electrically connected via the ends of windings thereof. As shown in FIG. 1, a conventional transformer 1 includes a core set 11, a bobbin 12, a primary winding (not shown) and a secondary winding (not shown). The primary and secondary windings surround the bobbin 12, and have electromagnetic interactions with the core set 11 to achieve voltage conversion. The winding ends of the primary and secondary windings are connected with copper wires 131, 132, 133 covered with PVC films by soldering. The free ends of the copper wires 131, 132, 133 are provided with fixed terminals 1311, 1321, 1331. The copper wires 131, 132, 133 are then connected with the circuit board (not shown) of the electronic device via the fixed terminals 1311, 1321, 1331.

Please refer to FIGS. 2*a* and 2*b*. Another conventional transformer 1A has the improved connection of the winding ends illustrated as follows. First, the primary and secondary windings are wound around the bobbin 12. The winding part around the bobbin 12 is covered with an insulating tape 14. There are totally four winding ends 121, 122, 123, 124 pulled out from the primary and secondary windings. The winding end 121 is connected with a copper wire 131*a*, the winding end 122 is connected with the copper wire 132*a*, and the winding ends 123, 124 are connected with the copper wire 133*a*. Therefore, the winding ends 121, 122, 123, 124 are connected with the circuit board (not shown) of the electronic device via the copper wires 131*a*, 132*a*, 133*a*.

As shown in FIG. 2*c*, in order to prevent the copper wires 131*a*, 132*a*, 133*a* from direct contact with each other and to prevent short circuits and thus burning of the transformer 1A because the soldering points pierce the PVC insulating films, the conventional transformer uses tapes and pads to separate the exposed parts of copper wires and the soldering points. The copper wire 131*a* connected with the winding end 121 is bent upward and applied with one or several layers of insulating tapes 14 and a pad 15, thereby covering the exposed and soldering parts of the copper wire. The other winding ends 122, 123, 124 and the corresponding copper wires 132*a*, 133*a* can be processed in the same way. Therefore, the copper wires 131*a*, 132*a*, 133*a* can be fixed and organized to prevent wire intertwining and short circuits.

Nevertheless, the drawbacks of the conventional transformers are as follows. The transformer 1A requires a lot of tapes and pads. The circuit board for fixing and organizing wires does not have any function other than insulation. This complicates the structure of the transformer 1A and increases its costs. Moreover, the involved processes of taping and inserting pads lower the yield. Since the winding ends 121, 122, 123, 124 need to be connected to the corresponding copper wires 131*a*, 132*a*, 133*a* by soldering, the quality of the transformer 1A can be lowered due to the piercing problem at soldering points. Moreover, the PVC has a lower melting point (about 105° C.), so the transformer 1A using the copper wires covered with PVC is thus susceptible to heat.

As shown in FIG. 3, another conventional transformer 2 includes a core set 21, a bobbin 22, a primary winding 231, a secondary winding 232 and several pins 241, 242, 243, 244, 245. The primary winding 231 and the secondary winding 232 have several winding ends. The pins 241, 242, 243, 244, 245 are fixed to the bobbin 22 and connected with the winding ends before they are electrically connected with the circuit board. However, when the bobbin 22 forms the pins 241, 242, 243, 244, 245, they can only be fixed at fixed positions of the bobbin 22. It is only applicable to a single specification of bobbin and circuit board. The pins 241, 242, 243, 244, 245 are not flexible in configuration. In addition, when the ends of the transformer 2 are electrically connected with the pins 241, 242, 243, 244, 245, it is likely to have short circuit when the transformer 2 is inserted into a circuit board because the exposed ends are not insulated.

Therefore, it is an important subject to provide a transformer with fixed pins that can improve the above-mentioned drawbacks.

SUMMARY OF THE INVENTION

In view of the foregoing, the invention is to provide a transformer with fixed pins that can readily combined with circuit board of all kinds of specifications to establish electrical connections. Thus, the transformer of the invention can reduce the cost, shorten the manufacturing time, and increase the production rate and yield.

To achieve the above, the invention discloses a transformer includes a transformer including a bobbin, a primary winding, a secondary winding, a core set and a plurality pins. The primary winding and the secondary winding are wound around the bobbin and both have a plurality of winding ends. The core set surrounds the primary winding and the secondary winding. Each of the pins is fixed to the bobbin and electrically connected with a corresponding winding end. The transformer further includes a fixing plate, and the pins are fixed to the bobbin through the fixing plate.

As mentioned above, the transformed with fixed pins of the invention has the pins connecting with a fixing plate to form a modularized structure. The modularized structure is fixed on a bobbin, forming electrically connections with the winding ends. An insulating structure and a protecting structure cover the modularized structure. Compared with the conventional transformer, the invention can directly fix the winding ends to the pins of the modularized structure. That is, no soldering is required in order to prevent the piercing problem. The material also has no high temperature limitation while processing. The invention thus can reduce the production cost and manufacturing time while increasing the production quality and yield. Since the shapes and sizes of the fixing plate in the invention can be modified, the positions of the pins can be flexibly configured to fit the models and specifications of all kinds of bobbins. The transformer can achieve electrical connections with holes on a circuit board.

BRIEF DESCRIPTION OF THE DRAWINGS

The invention will become more fully understood from the subsequent detailed description and the accompany drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
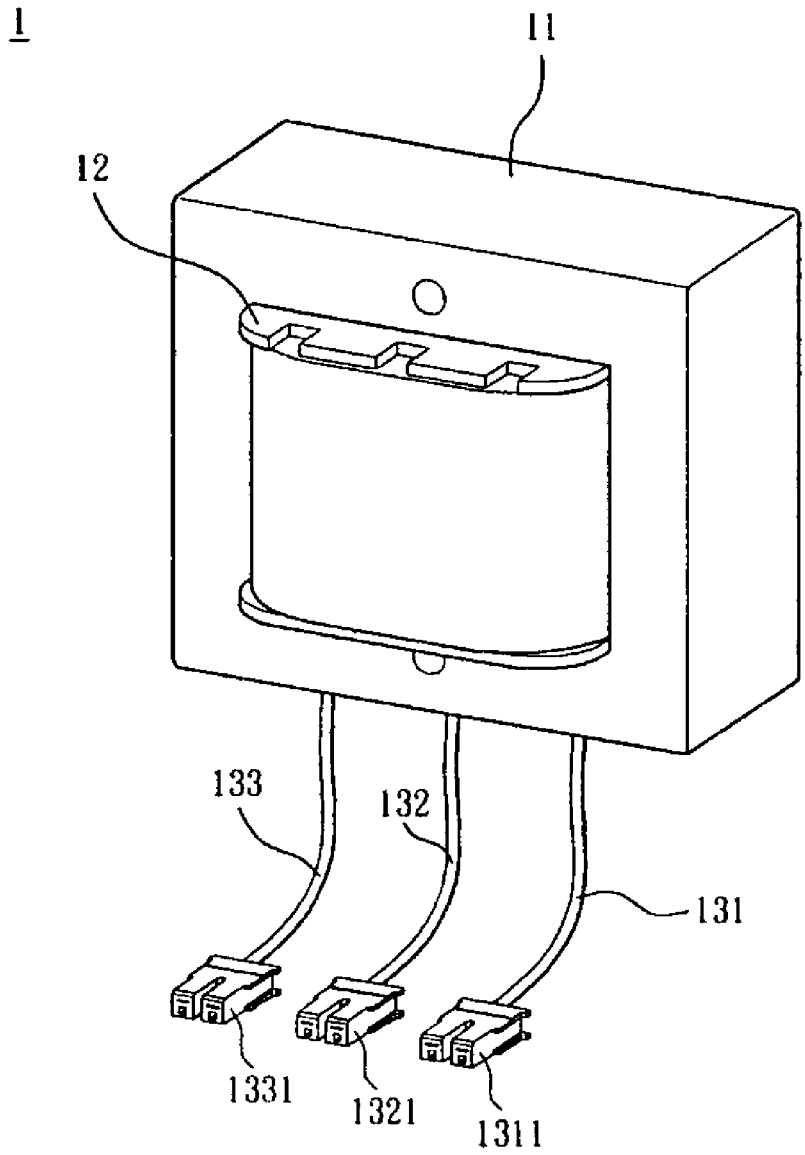
FIG. 1(PRIOR ART)
FIG. 1 is a schematic view of a conventional transformer.
Figure 2A:
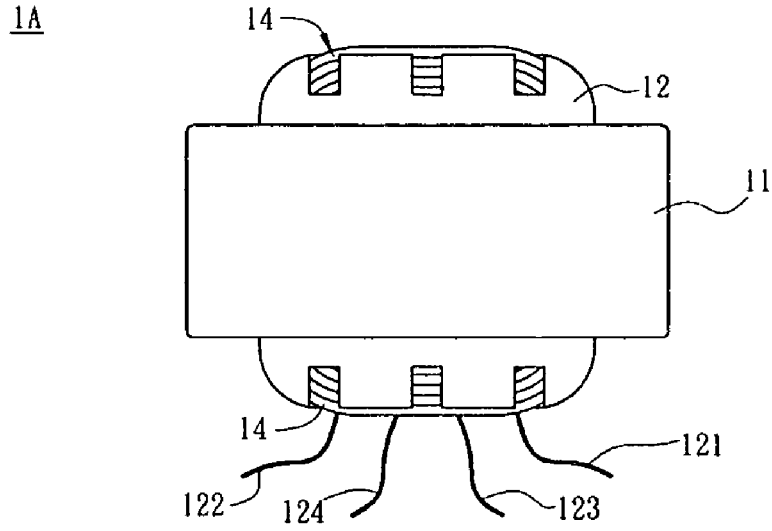
FIG. 2a(PRIOR ART)
FIGS. 2*a* to 2*c* are schematic views of another conventional transformer.
Figure 2B:
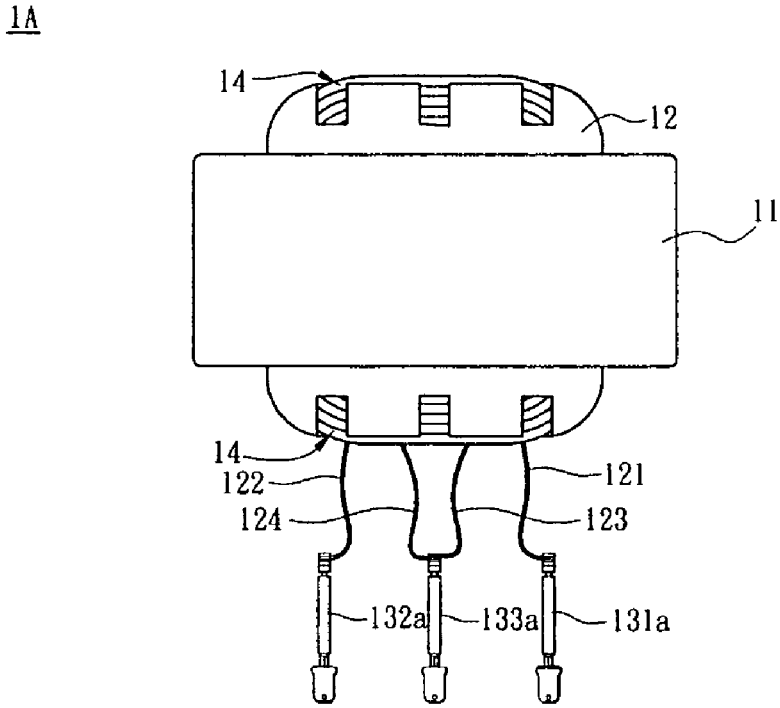
FIG. 2b(PRIOR ART)
Figure 2C:
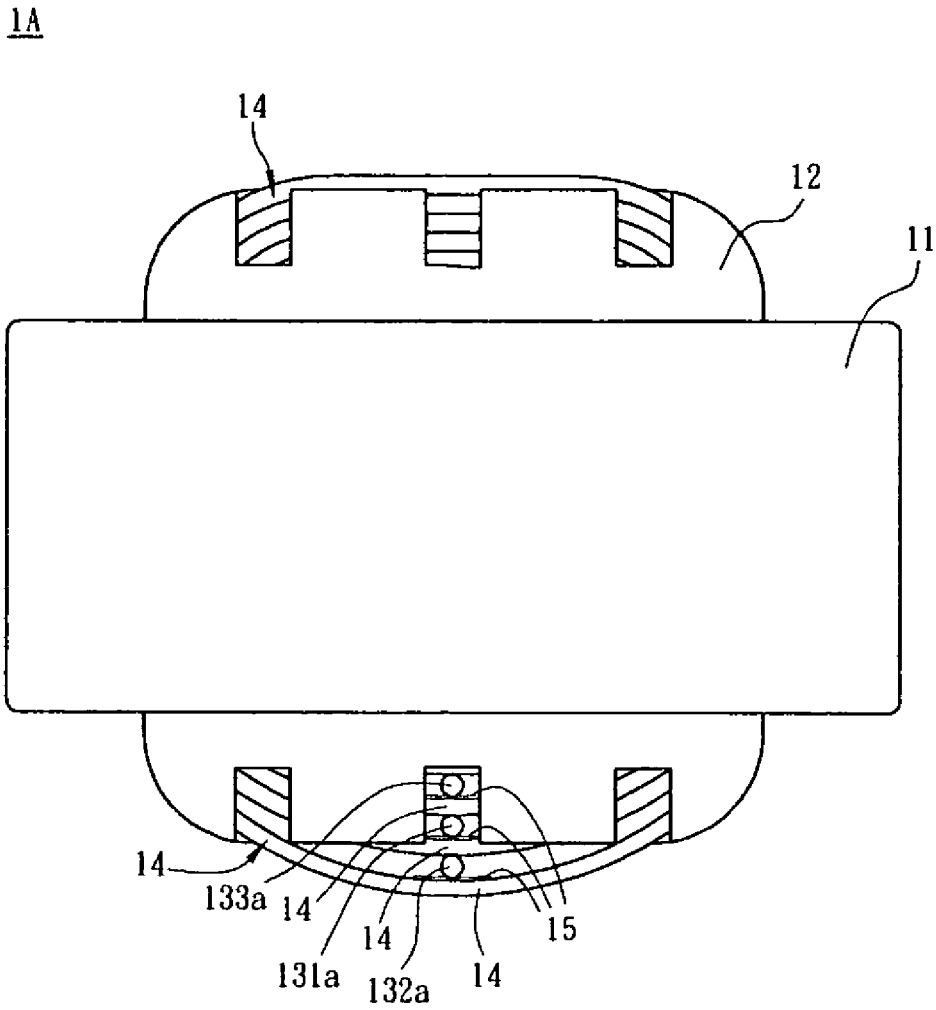
FIG. 2c(PRIOR ART)
Figure 3:
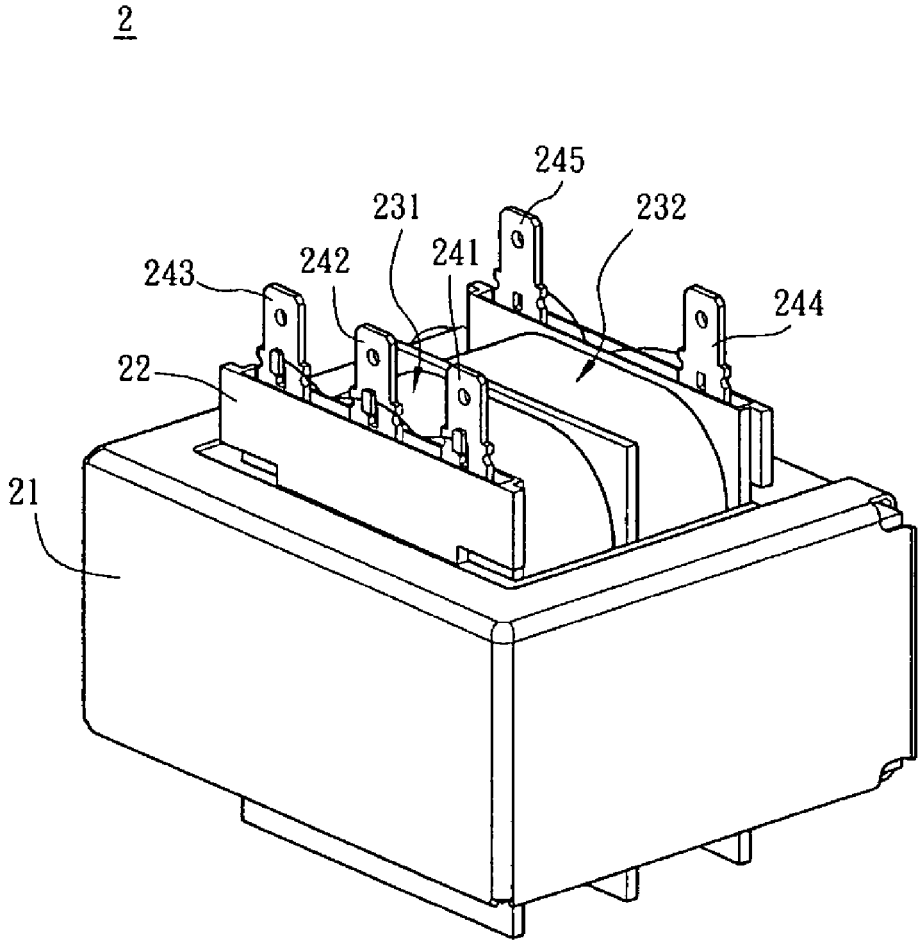
FIG. 3(PRIOR ART)
FIG. 3 is a schematic view of yet another conventional transformer.
Figure 4:
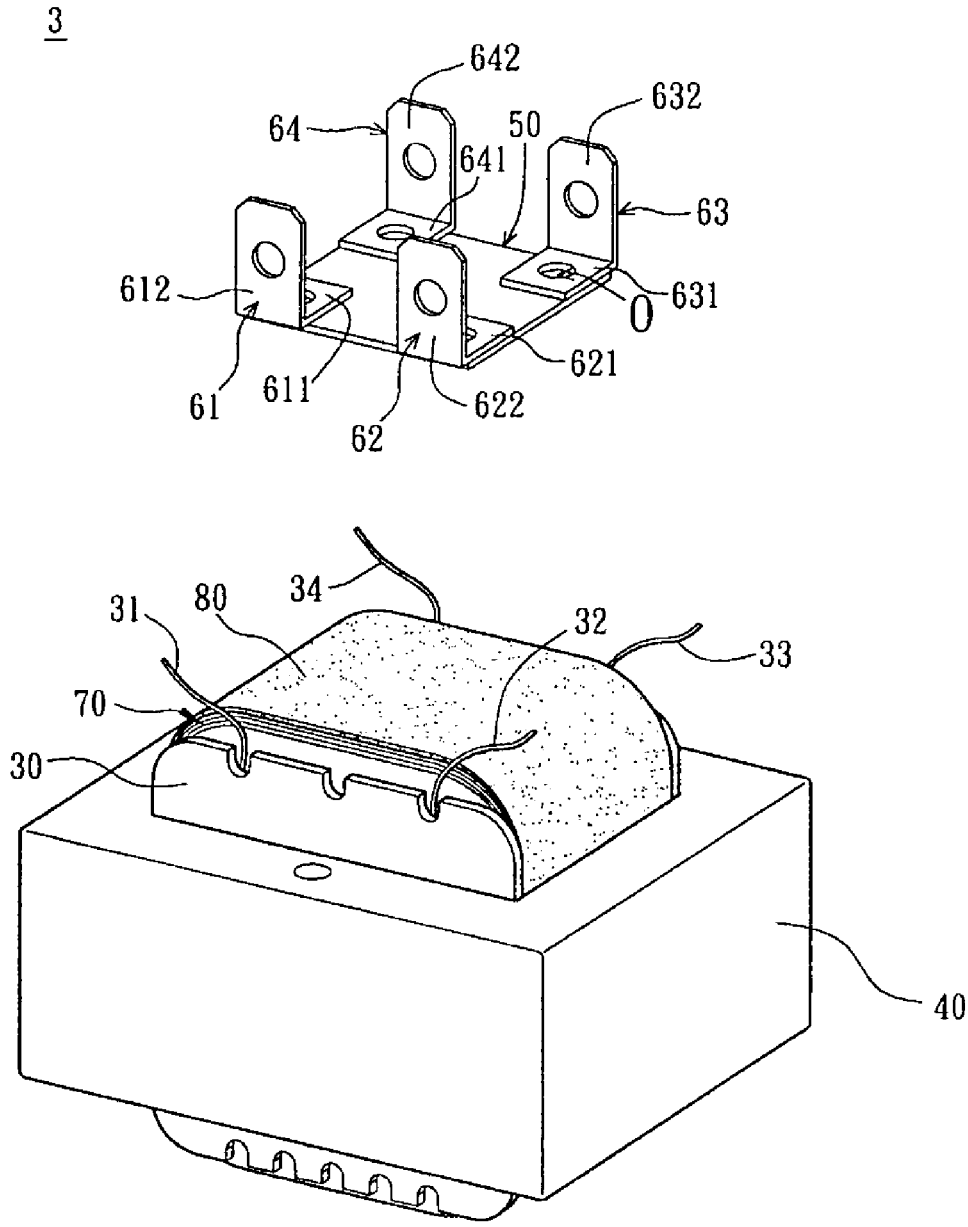
FIG. 4 is an exploded view of a transformer with fixed pins according to an embodiment of the invention.

As shown in FIG. 4, a transformer 3 according to the embodiment of the invention includes a bobbin 30, a primary winding (not shown), a secondary winding (not shown), a core set 40 and several pins 61, 62, 63, 64. The transformer 3 further includes a fixing plate 50, an insulating structure 70, and a protecting structure 80. In this embodiment, the primary and secondary windings are wound around the bobbin 30 and have two winding ends 31, 32 and 33, 34, respectively. The insulating structure 70 is, for example, an insulating tape covering the primary and secondary windings and exposing the winding ends 31, 32, 33, 34. The fixing plate 50 is made of an electrical insulator and disposed on the insulating structure 70. The pins 61, 62, 63, 64 are fixed to the bobbin 30 through the fixing plate 50. Each of the pins 61, 62, 63, 64 has a fixing part 611, 621, 631, 641 and a connecting part 612, 622, 632, 642, respectively. The pins 61, 62, 63, 64 are fixed on the fixing plate 50 by gluing, locking, embedding, hooking, pressing, soldering, thermal welding, or ultrasonic welding. Moreover, the fixing parts 611, 621, 631, 641 have a through hole O, respectively, and are connected with the winding ends 31, 32, 33, 34 so that the pins 61, 62, 63, 64 are electrically connected with the circuit board. The fixing plate 50 is fixed to the bobbin 30 by gluing, locking, embedding, hooking, pressing, soldering, thermal welding, or ultrasonic welding. Alternatively, the fixing plate 50 is formed with the pins 61, 62, 63, 64 as a monolithic piece. The protecting structure 80 is made of a non-conductive material, for example but not limited to, kraft paper or an insulating tape, and used to cover the insulating structure 70 and the bobbin 30. Alternatively, the protecting structure 80 can be formed by fixing the fixing plate 50 on the insulating structure 70 and then covering the fixing plate 50, the insulating structure 70 and the bobbin 30.

With reference to FIG. 4, the transformer 3 is assembled as follows. The primary and secondary windings are wound around the bobbin 30 with the exposed winding ends 31, 32, 33, 34, respectively. The insulating structure 70 (e.g., an insulating tape) then covers winding parts of the primary and secondary windings. The fixing plate 50 and the pins 61, 62, 63, 64 fixed thereon are then provided. Four predetermined positioning holes are formed on the fixing plate 50 according to the circuit board design. The fixing parts 611, 621, 631,641 are formed with the through holes O corresponding to the predetermined positioning holes on the fixing plate 50 by stamping. The fixing parts 611, 621, 631, 641 are then fixed on the fixing plate 50 by soldering connections. Afterwards, the protecting structure 80, such as kraft paper, covers the insulating structure 70 and the bobbin 30, followed by installing the core set 40 and the bobbin 30.

Figure 5:
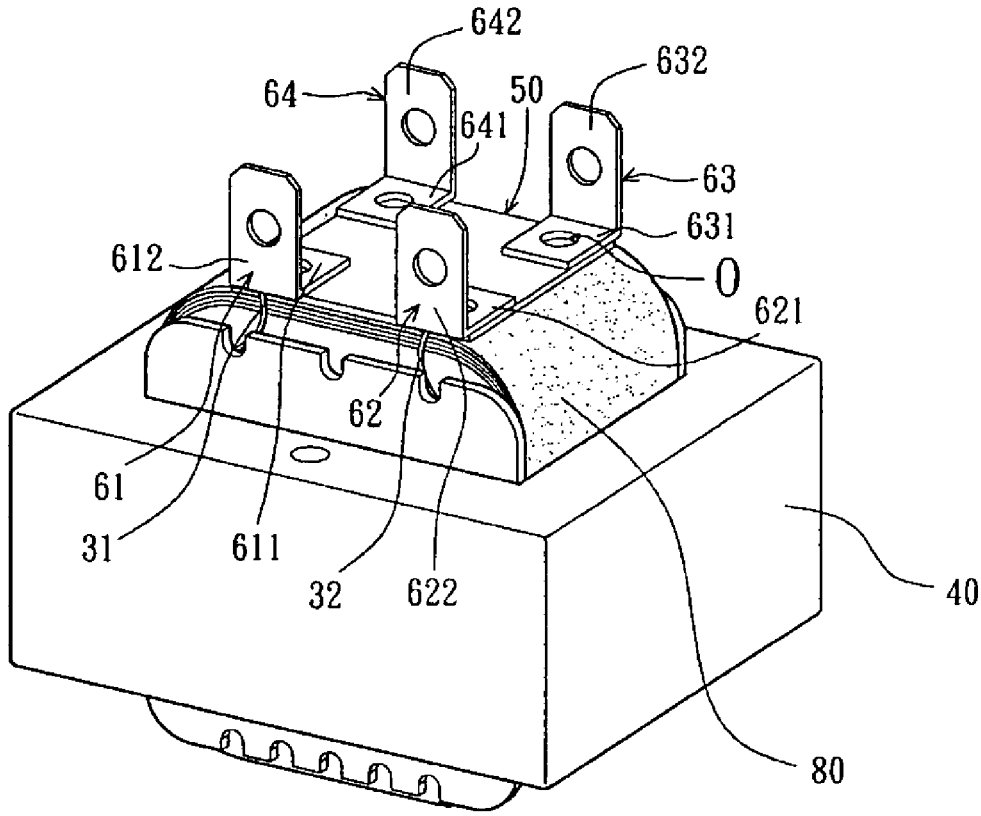
FIG. 5 shows the assembled transformer of FIG. 4.

As shown in FIG. 5, the fixing plate is fixed on the bobbin 30 by gluing or some other equivalent method so that the winding ends 31, 32, 33, 34 exposed from the primary and secondary windings are connected respectively to the fixing parts 611, 621, 631, 641 of the pins 61, 62, 63, 64. This completes the assembly of the transformer 3. In this embodiment, the pins 61, 62 are associated with the primary winding, and the pins 63, 64 are associated with the secondary winding.

Figure 6:
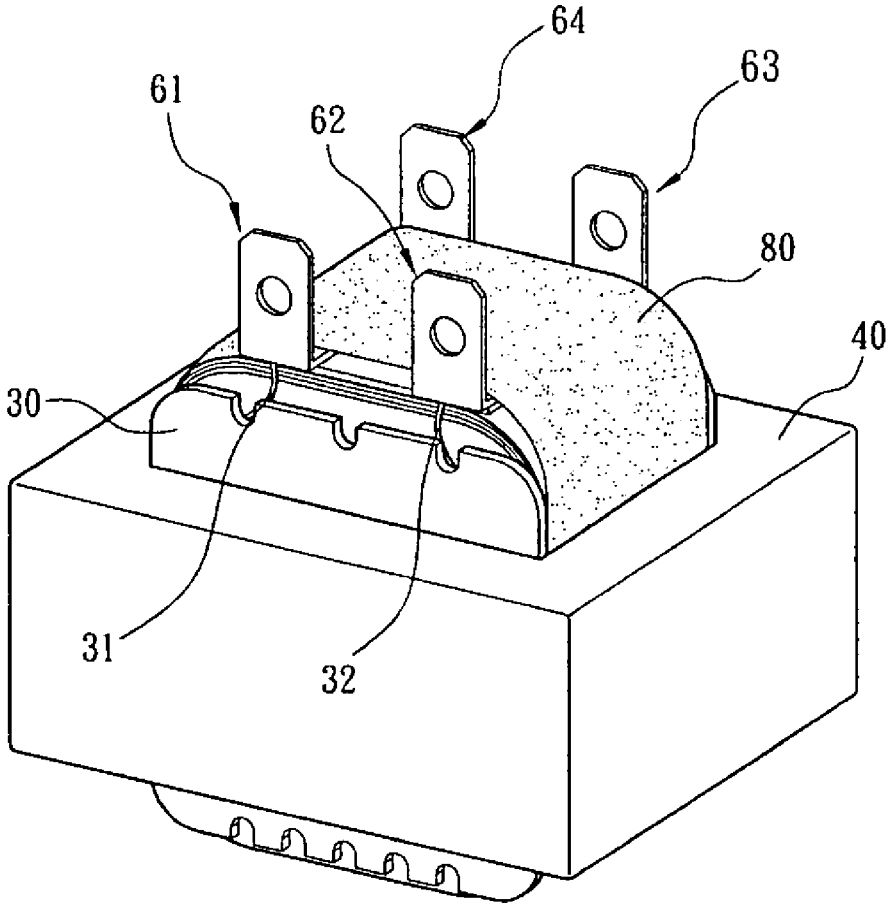
FIG. 6 shows another assembled transformer with fixed pins according to the embodiment of the invention.

As shown in FIG. 6, another transformer 4 according to the embodiment of the invention includes the similar components as the transformer 3. The difference between the transformers 3 and 4 is in their assembling procedures of the protecting structure 80. As shown in FIG. 6, the fixing plate 50 is fixed to the insulating structure 70, and then the protecting structure 80, such as such kraft paper, covers the fixing plate 50, the insulating structure 70 and the bobbin 30, followed by installing the core set 40 and the bobbin 30.

In summary, the transformed with fixed pins of the invention has the pins connecting with a fixing plate to form a modularized structure. The modularized structure is fixed on a bobbin, forming electrically connections with the winding ends. An insulating structure and a protecting structure cover the modularized structure. Compared with the conventional transformer, the invention can directly fix the winding ends to the pins of the modularized structure. That is, no soldering is required in order to prevent the piercing problem. The material also has no high temperature limitation while processing. The invention thus can reduce the production cost and manufacturing time while increasing the production quality and yield. Since the shapes and sizes of the fixing plate in the invention can be modified, the positions of the pins can be flexibly configured to fit the models and specifications of all kinds of bobbins. The transformer can achieve electrical connections with holes on a circuit board.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A transformer comprising:

a bobbin;

a primary winding wound around the bobbin and having a plurality of winding ends;

a secondary winding wound around the bobbin and having a plurality of winding ends;

a core set surrounding the primary and secondary windings;

an insulating structure covering the primary winding and the secondary winding and leaving the winding ends exposed;

a fixing plate disposed on the insulating structure; and a plurality of pins fixed to the bobbin and electrically connected with corresponding winding ends.

2. The transformer of claim 1, wherein the pins are fixed upon the bobbin through the fixing plate.

3. The transformer of claim 2, wherein the fixing plate is made of an electrical insulator.

4. The transformer of claim 2, wherein each of the pins has a fixing part and a connecting part.

5. The transformer of claim 4, wherein the fixing part is fixed to the fixing plate.

6. The transformer of claim 5, wherein the fixing part is fixed to the fixing plate by gluing, locking, embedding, locking, pressing, soldering, thermal welding, or ultrasonic welding.

7. The transformer of claim 5, wherein the fixing part has a through hole, and the corresponding pin is fixed on the fixing plate and electrically connected with the associated winding end through the through hole.

8. The transformer of claim 2, wherein the fixing plate is fixed to the bobbin or the insulating structure by gluing, locking, embedding, locking, pressing, soldering, thermal welding, or ultrasonic welding.

9. The transformer of claim 8, wherein the insulating structure includes an insulating tape.

10. The transformer of claim 1, further comprising a protecting structure covering the insulating structure and the bobbin.

11. The transformer of claim 10, wherein the protecting structure covers the fixing plate, the insulating structure and the bobbin.

12. The transformer of claim 11, wherein the protecting structure is made of an electrical insulator.

13. The transformer of claim 12, wherein the protecting structure includes a kraft paper or an insulating tape.

14. The transformer of claim 2, wherein the fixing plate and the pins are formed as a monolithic piece.

15. A transformer comprising:

a bobbin;

a primary winding wound around the bobbin and having a plurality of winding ends;

a secondary winding wound around the bobbin and having a plurality of winding ends;

a core set surrounding the primary and secondary windings;

a plurality of pins fixed to the bobbin and electrically connected with corresponding winding ends; and a fixing plate, wherein the pins are fixed upon the bobbin through the fixing plate;

wherein each of the pins has a fixing part, the fixing part is fixed to the fixing plate, the fixing part has a through hole, and the corresponding pin is fixed on the fixing plate and electrically connected with the associated winding end through the through hole.

16. A transformer comprising:

a bobbin;

a primary winding wound around the bobbin and having a plurality of winding ends;

a secondary winding wound around the bobbin and having a plurality of winding ends;

a core set surrounding the primary and secondary windings;

a plurality of pins fixed to the bobbin and electrically connected with corresponding winding ends; and a fixing plate, wherein the pins are fixed upon the bobbin through the fixing plate, wherein the fixing plate and the pins are formed as a monolithic piece.

* * * * *